United States Patent [19]

Howard

[11] 4,441,434

[45] Apr. 10, 1984

[54] APPARATUS FOR DISPENSING PARTICULATE MATTER

[76] Inventor: Henry R. Howard, Rte. 1, Box 203, Lancaster, S.C. 29720

[21] Appl. No.: 314,822

[22] Filed: Oct. 26, 1981

[51] Int. Cl.[3] ..... F23K 3/00

[52] U.S. Cl. ..... 110/101 R; 110/104 R; 110/347; 222/368; 241/295

[58] Field of Search ..... 241/294, 295; 222/368, 222/369; 110/101 CF, 102, 106, 115, 222, 101 R, 118, 288, 275, 263; 222/368, 369, 274

[56] References Cited

U.S. PATENT DOCUMENTS

| | | | |
|---|---|---|---|
| 1,174,088 | 3/1916 | Mulock | 110/101 R |
| 1,213,820 | 1/1917 | Bergman | 110/265 X |
| 1,265,290 | 5/1918 | Cantrell | 222/368 |
| 2,090,965 | 8/1937 | Ruth . | |
| 3,048,132 | 8/1962 | Morgan et al. | 222/368 |
| 4,257,334 | 3/1981 | Mueller | 110/347 X |

FOREIGN PATENT DOCUMENTS

| | | | |
|---|---|---|---|
| 138202 | 1/1902 | Fed. Rep. of Germany . | |
| 2309280 | 11/1976 | France | 241/186 R |

*Primary Examiner*—Henry C. Yuen
*Assistant Examiner*—David E. Helmbold
*Attorney, Agent, or Firm*—W. Thad Adams, III

[57] ABSTRACT

An apparatus for dispensing and injecting solid fuel in particulate form into a combustion chamber (10) in measured quantities and at variable rates and intermittencies is described. The apparatus (30) is comprised of a fuel hopper (31), at least one circular disk (50) rotatably mounted with at least a portion of its circumference in communication with the fuel hopper (31). A plurality of pockets (51) are spaced apart around the circumferential periphery of disk (50) for receiving and dispensing fuel from fuel hopper (31) at rates and intermittencies corresponding to the speed of rotation of circular disk (50) and the volumetric capacity and spacing of pockets (51). Circular disks (50) are mounted on a common drive shaft (52) which is driven by a variable speed motor (54). A venturi (80) is provided for dispersing fuel into combustion chamber (10).

8 Claims, 9 Drawing Figures

APPARATUS FOR DISPENSING PARTICULATE MATTER

TECHNICAL FIELD AND BACKGROUND OF THE INVENTION

This invention relates to an apparatus for dispensing particulate matter. The apparatus includes a feeder, comprising a circular disk which dispenses particulate matter from a supply source. The invention has application in numerous areas where particulate matter is required to be dispensed in measured quantities and at precise rates.

The particular disclosure of this application is of an apparatus for dispensing and injecting sawdust into a kiln used for firing brick. A kiln generally comprises a long tunnel-like enclosure formed of refractory brick. While the details of commercial brick manufacture vary considerably, in the disclosure below individual bricks are molded and then placed in a pre-determined arrangement on small flatbed railway cars. The bricks are first dried in a dryer which uses waste heat from the kiln. The individual cars carrying the brick roll on railway tracks down the length of the kiln. Each time a new load of brick is rolled into the kiln, each car in front of it is moved further along the kiln. This process is called the "intermittent push" method and results in one car of fired brick exiting the kiln as each car of brick enters from the other end. Upon entering the kiln, the dried bricks are preheated to a temperature of approximately 500° F. (260° C.). The bricks then enter a furnace zone of the kiln where the heat gradually increases from approximately 1,400° F. (760° C.) to 2,000° F. (1093° C.). From the furnace zone of the kiln the ricks move into a cooling zone where the heat absorbed by the bricks is gradually dissipated. The waste heat from the cooling area is conveyed to the dryer.

The temperatures within the furnace zone of the kiln must be maintained within very close tolerances. Firing the bricks to a temperature even 25° F. (14° C.) lower than optimum can result in bricks being too soft and absorbent to meet building requirements. Conversly, firing the bricks at a temperature 25° F. (14° C.) higher than optimum can cause vitrification, whereby bricks turn into a glass-like substance with virtually no absorbency. For this reason, the temperatures within the kiln are very closely monitored. In order to maintain the temperature within very close tolerances, the amount of fuel being consumed within the kiln must be closely monitored and adjusted periodically. This is relatively easy to accomplish when the kiln is heated with liquid or gaseous fuel, such as diesel fuel or natural gas. However, because of the substantial price increases in petroleum and natural gas in recent years, the use of these fuels has, in most cases, become economically impractical. For this reason more and more kilns are being converted to burn sawdust or some other non-petroleum fuel. In areas of the United States having large lumber or furniture manufacturing industries sawdust can be purchased as a waste product at inexpensive prices, making it a highly economical fuel. For example, approximately 600 lbs. (272 kg.) of sawdust has the equivalent B.T.U. (Kg.-cal.) output of 45 gallons (170 liters) of diesel fuel or 5,000 cubic feet (142 cubic meters) of natural gas. At a typical price of $30.00 per short ton (0.85 metric tons) of sawdust delivered to the kiln, the economic advantages of sawdust as a fuel are apparent.

However, the physical characteristics of sawdust have caused substantial problems in using it as a kiln fuel where precise control of the feed rate is essential to maintaining the kiln temperature within required tolerances. As mentioned above, sawdust is often purchased by brick manufacturers from lumber yards or furniture factories where the sawdust is generated as a waste product. The physical characteristics of the sawdust may vary substantially depending on the process by which it was produced, the type of wood and its moisture content. Soft woods produce a fuzzy sawdust which tends to stick together in clumps. Other sawdust may contain long curls or strings of wood as well as wood chips and splinters.

Several prior art devices for feeding sawdust into a kiln are currently in use. One type of feeder uses a vibrating feed hopper which "sifts" sawdust onto a moving conveyor. The sawdust falls off the edge of the conveyor into one of a plurality of longitudinally aligned funnels. Each of the funnels feeds a separated injector which injects the sawdust into the kiln. However, these vibrating dispensers cannot increase or decrease the sawdust feed rate in a linear manner except within a very limited range. Below a certain level of vibration the sawdust ceases feeding properly. Above a certian level of vibration the rate of flow increases at far above a linear rate. Furthermore, no means are provided by which some injectors can be delivered greater quantities of sawdust than others. This makes it virtually impossible to compensate for temperature variations which may exist from one side of the kiln to the other.

Another system uses individual vibrators, each of which feeds a separate funnel. Individual feed rate control is therefore possible, however, the feed rates are still non-linear.

Another prior art feed system uses a "distributor" principle, whereby a central dispensing arm rotates and successively feeds from six to ten radially extending feed arms. Each feed arm dispenses the sawdust into a funnel and then into an injector. In this system, no individual control or continuous feeding is possible.

Yet another system is based on fertilizer feeder principle, much like those used on farms to fertilize crop acreage. Adjustable slot-type openings are provided in the bottom of a longitudinally extending funnel-shaed hopper. A rod having agitator blades extends down the length of the hopper just above the bottom openings and rotates, dispensing sawdust through the openings. Individual adjustment from one opening to the next is impossible, as is intermittent feeding.

An analysis of the above prior art systems and their respective deficiencies demonstrates that an ideal solid fuel feeding system should have three capabilities: First, the ability for a linear increase and decrease in feed rates across an extremely wide range; Second, individual feed control should be provided for each feed unit, since a conventional brick kiln has a very large number of separate fuel injector locations, each potentially requiring a slightly different feed rate; and, third, the system should be quickly and easily adjustable.

SUMMARY OF THE INVENTION

Therefore, it is an object of the invention to provide a feeder for dispensing particulate matter from a supply source in measured quantities at variable rates and intermittencies.

It is another object of the present invention to provide an apparatus for dispensing and injecting solid fuel in particulate form into a combustion chamber in measured quantities and a variable rates and intermittencies.

It is another object of the present invention to provide an apparatus which permits linear feed rate adjustment over an extremely wide range.

It is yet another object of the present invention to provide an apparatus which includes means for evenly dispersing the fuel into a moving fluid stream and injecting the fuel into a combustion chamber.

These and other objects and advantages of the present invention are achieved in the preferred embodiment of the apparatus below by providing a feeder comprising a circular disk for being rotatably mounted with at least a portion of its circumference in communication with a particulate matter supply source. The circular disk is provided with a plurality of spaced-apart pockets at intervals around its circumferential periphery for receiving and dispensing particulate matter from the supply source at rates and intermittencies corresponding to the speed of rotation of the circular disk. According to one embodiment of the invention, the circular disk defines at least two matable disk segments having complementary non-circumferential sides. At least one of the disk segments is provdided with a plurality of pockets at spaced-apart intervals around its circumferential periphery for receiving and dispensing particulate matter from the particulate matter supply source. The rate and intermittency at which the particulate matter is dispensed corresponds to the speed of rotation of the circular disk, the volumetric capacity and spacing of the pockets around the periphery of the circular disk, and the extent of the arc of the circular disk having the pockets therein.

Preferably, a plurality of the circular disks are mounted in axially spaced-apart relation on a common, rotatable shaft. As described below, one preferred embodiment of the invention includes a flange mounted on the shaft for rotation therewith, to which the disk segments are secured whereby any one of the disk segments may be mounted to or removed from the flange without the mounting to or removal from the flange of any other of the disk segments.

According to one embodiment of the invention described below, means are disclosed for dispersing the fuel after being dispensed by the circular disk into a stream of air, and then injecting the fuel into a combustion chamber.

BRIEF DESCRIPION OF THE DRAWINGS

Some of the objects of the invention have been set forth above. Other objects and advantages of the invention will appear as the description of the invention proceeds, when taken in conjunction with the following drawings, in which.

DESCRIPTION OF THE PREFERRED EMBODIMENT

Figure 1:
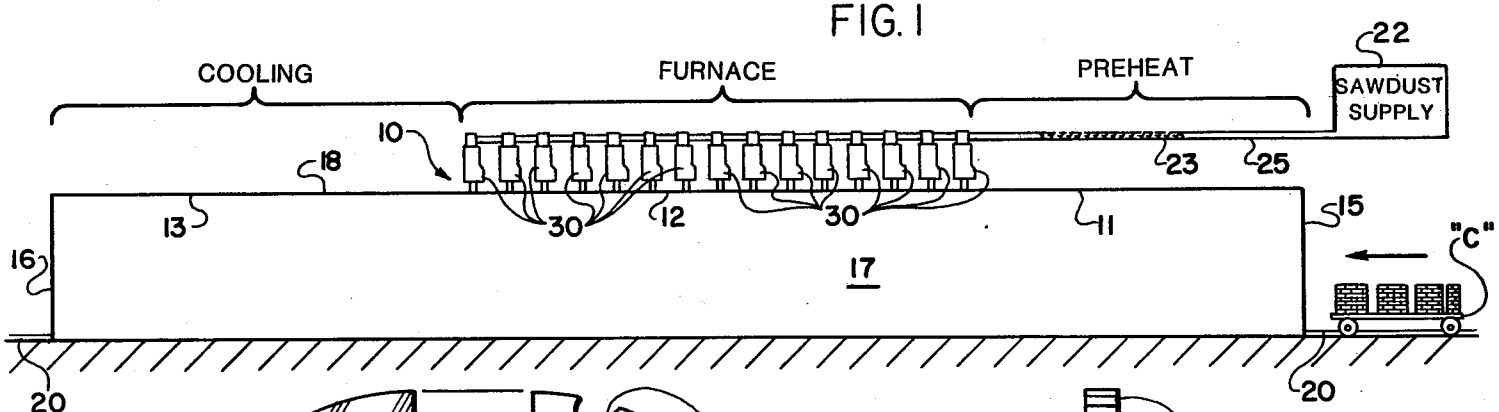
FIG. 1 is a side elevation view of a conventional brick kiln.
Figure 4:
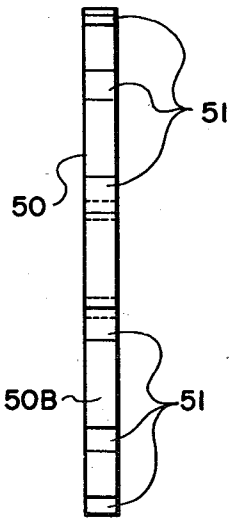
FIG. 4 is an edge view of the circular disk shown in FIG. 3.

Referring now to the drawings, a conventional, top fed kiln is shown in FIG. 1 at broad reference numeral 10. Kiln 10 is typically several hundred feet long and includes a pre-heating zone 11, a furnace zone 12 and a cooling zone 13. Kiln 10 has a tunnel-like configuration with an entrance 15 on one end and an exit 16 on the opposite end, each being defined by opposing side walls 17 and a top wall 18 constructed of refractory brick.

Brick passes through kiln 10 on small, flatbed railway cars "C" which roll along tracks 20. Because of the tremendous amount of heat which must be generated within kiln 10, the furnace zone 12 is heated by a plurality of apparati 30 according to the present invention which are placed in spaced-apart relation along top wall 18 above furnace zone 12. Fuel, in the form of sawdust, is fed to each apparatus 30 from a fuel supply 22 by means of a feed auger 23 rotating within a conduit 25.

Figure 2:
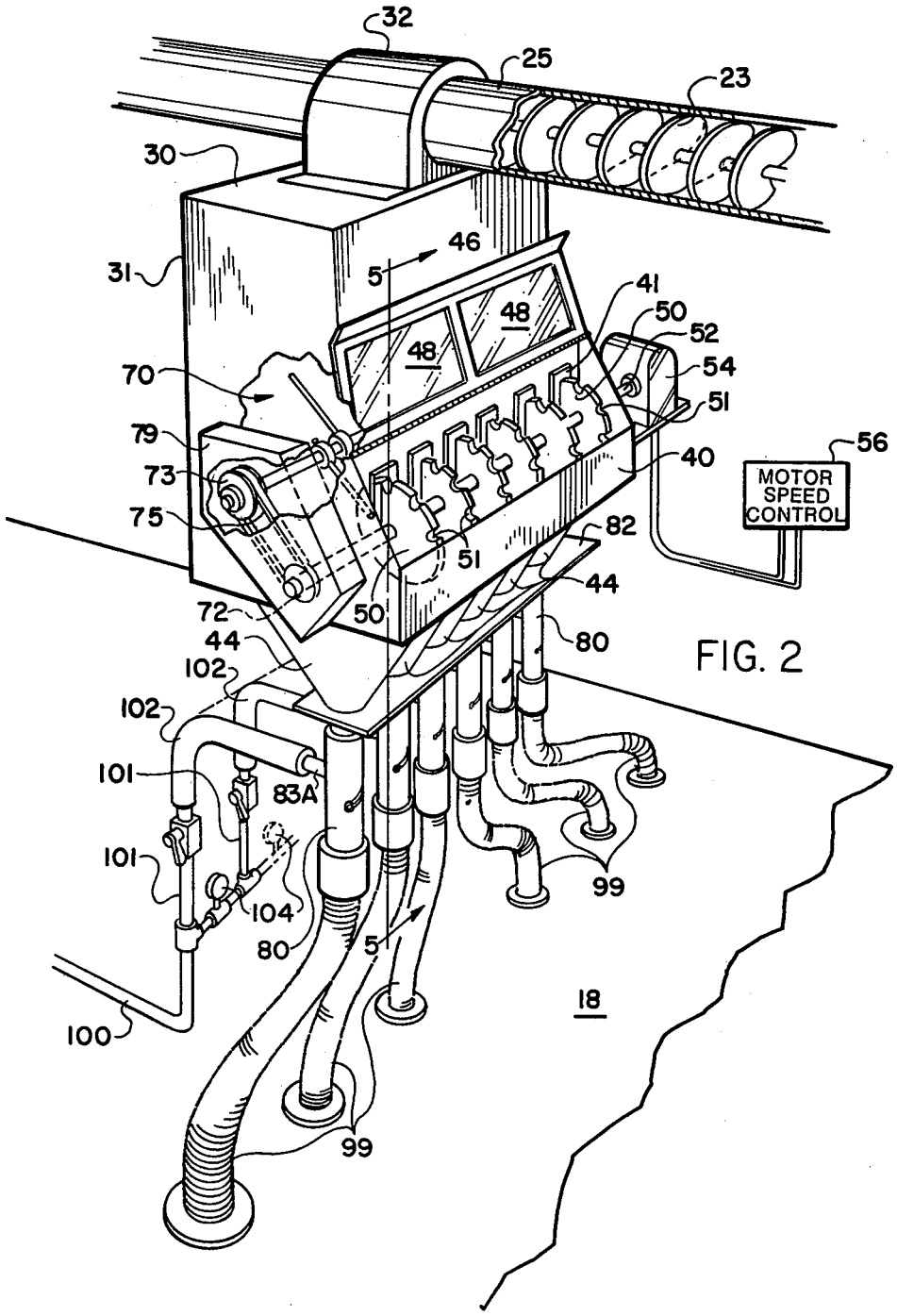
FIG. 2 is a perspective view of a preferred embodiment of the apparatus according to the present invention, with parts broken away to show details of the internal structure thereof.

Referring now to FIG. 2, a single apparatus 30 is shown for illustrative purposes mounted on top wall 18 of kiln 10. The apparatus 30 is comprised of a fuel hopper 31 mounted in fuel receiving relation to the fuel supply conduit 25. A metal shroud 32 covers the opening of the fuel supply conduit 25 into fuel hopper 31.

A feed enclosure 40 is provided on the lower end of the fuel hopper 31. Rotatably mounted within the feed enclosure 40 are six circular disks 50 which dispense sawdust in measured quantities into the feed enclosure 40. The sawdust passes from the feed enclosure 40 into six venturis 80, through flexible pipes 99 and then into kiln 10. The broad structures identified above will now be described in more detail. Reference numerals are omitted from some identical elements for purposes of illustrative clarity.

Figure 6:
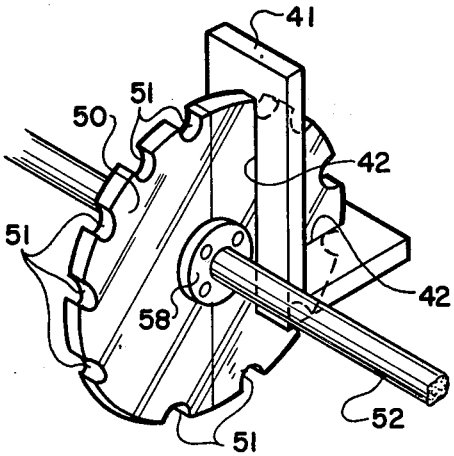
FIG. 6 is a perspective view of a circular disk according to one embodiment of the present invention, positioned in a restrictor plate through which the circular disk communicates with the supply source.

Feed closure 40 communicates with fuel hopper 31 through six laterally spaced-apart restrictor plates 41. As is shown in FIG. 6, each restrictor plate 41 comprises an "L" shaped member having a centrally disposed "L" shaped slot 42. As is shown in FIG. 2, the bottom of the feed enclosure 40 defines six funnels 44—each funnel 44 being below and in substantially vertical alignment with a restrictor plate 41. Feed enclosure 40 is provided with an access door 46 having two observation windows 48.

Figure 5:
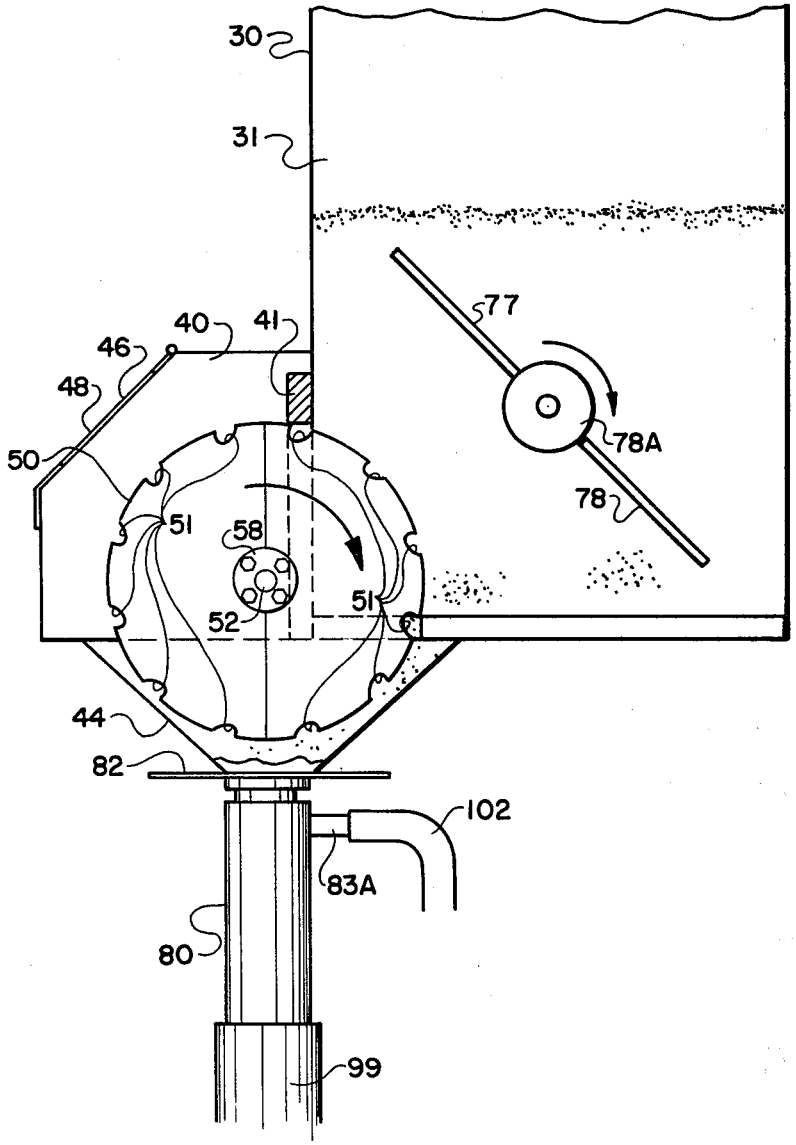
FIG. 5 is a vertical cross sectional view of an apparatus according to the present invention, taken substantially along lines 5—5 of FIG. 2.

Positioned within feed enclosure 40 are six feeders each of which comprises a circular disk 50 having a plurality of pockets 51 formed in spaced-apart relation around its circumferential periphery. The six circular disks 50 are mounted on a common drive shaft 52 which is driven by a variable speed DC motor 54. The speed of the DC motor 54 may be controlled manually, or if preferred, by a motor speed control 56 which will be described in further detail below. Each circular disk 50 is mounted for rotation on drive shaft 52 by means of a flange 58, as is illustrated in FIG. 6. As best shown in FIGS. 2 and 5, each circular disk 50 is mounted for rotation within the feed enclosure so that a portion of the circumferential periphery of each circular disk 50 communicates through its respective restrictor plate 41 into the fuel hopper 31. As a circular disk 50 rotates, sawdust is collected in pockets 51, and as each successive pocket 51 passes back into feed enclosure 40 from the fuel hopper 31 the sawdust is deposited in funnel 44, positioned below. Restrictor plate 41 is designed so that circular disk 50 occupies the entire interior dimensions of slot 42 to a relatively close toelrance. Therefore, only sawdust which is trapped in pockets 51 is permitted to exit the fuel hopper 31 through the restrictor plate 41. As is best shown in FIG. 5, the thickness of restrictor plate 41 is at least equal to the length of each pocket 51, so that as each pocket 51 passes from fuel hopper 31 through slot 42, a presice quantity of sawdust is trapped in pocket 51, and then deposited in hopper 44. In this way, sawdust is not permitted to refill pocket 51 through the top as it is emptying from the bottom.

The construction of circular disk 50 permits easy and rapid changes and repairs and also permits a very wide range of feed rates and feed intermittencies to be accommodated. According to FIG. 3, disk 50 can be comprised of two disk segments **50*a* 50*b*, which have complementary, non-circumferential sides. Each non-circumferential side defines a centrally disposed, semi-circular opening permitting each disk segment to be placed in position around drive shaft 52. Disk segments 50*a* and 50*b* are then bolted to flange 58 to form circular disk 50**.

Figure 3:
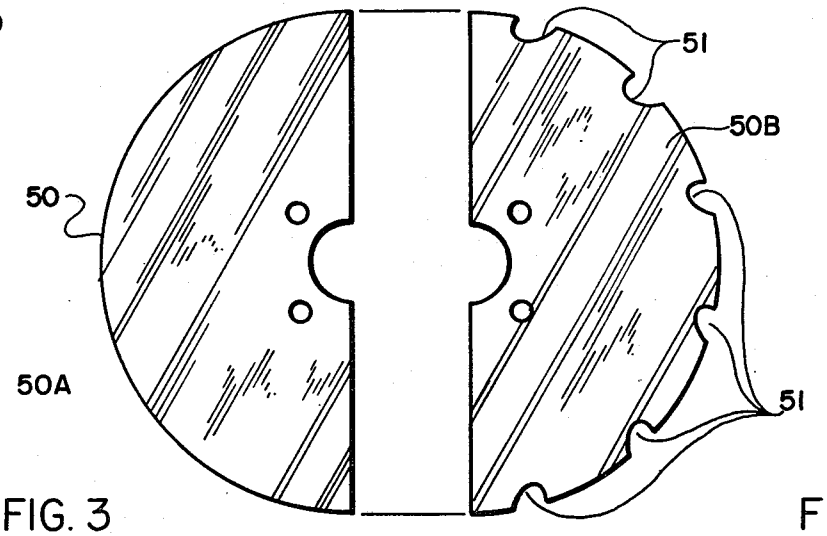
FIG. 3 is a side elevation view of a circular feed disk according to one embodiment of the present invention.

As is shown in FIG. 3, disk segment **50*a* has a smooth peripheral edge. Therefore, the kiln 10 will be fed sawdust during one half of each revolution of the circular disk 50. Of course, many other variations are possible. For example, the spacing of the pockets around the circumference of the disk segment may be closer together of further apart. Also, the pockets in one disk segment may be larger or smaller than the pockets on the other disk segments. If feeding is desired during two thirds of each revolution of circular disk 50, three disk segments may be provided with one disk segment having a smooth circumference. This allows the operator to take into account and compensate for peculiarities which are present from one kiln to another or in different areas of the same kiln. Forming circular disk 50 from disk segments 50*a* and 50*b* also permits the operator to remove and replace a circular disk 50 without having to disassemble the drive shaft 52 from the feed enclosure 40. Furthermore, should one of the disk segments 50*a* or 50*b*** be damaged or otherwise in need of replacement, only that segment need be removed.

Figure 7:
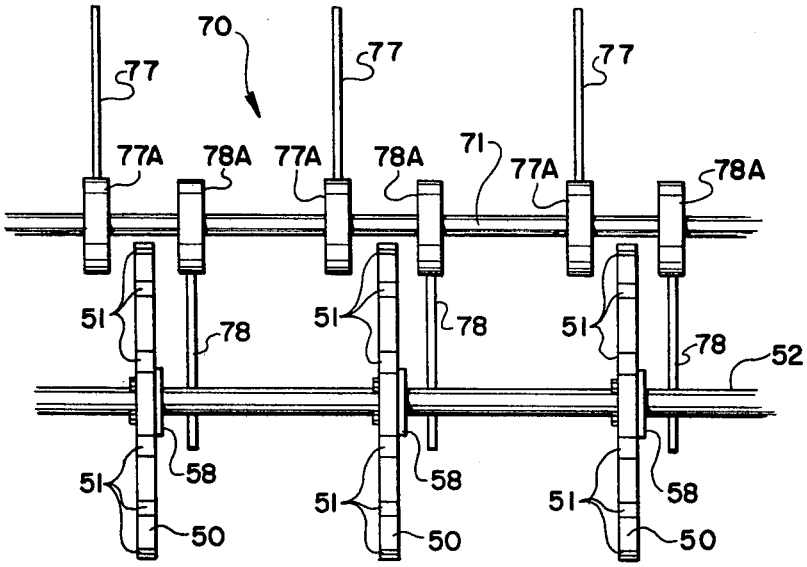
FIG. 7 shows the arrangement of agitator rods within the supply hopper and their relationship to the circualr disks according to the present invention.

An agitator assembly 70 is provided in order to maintain a continuous supply of sawdust in direct contact with pockets 51. Agitator assembly 70 comprises a rotatable shaft 71 which is driven from drive shaft 52 through pulleys 72 and 73 by means of a pulley belt 75. Positioned on shaft 71 is a pair of agitator bars 77 and 78 for each of the circular disks 50. Agitator bars 77 and 78 are fixedly secured onto hubs **77*a* and 78*a*, respectively, and are positioned on shaft 71 in 180° opposition to each other. As is best shown in FIG. 7, agitator bars 77 and 78 are positioned, respectively on opposite axial sides of each circular disk 50 and continually push sawdust from the rear of the fuel hopper 31 into contact therewith. Agitator bars 77 and 78 are preferably constructed of spring steel and are relatively thin so that they create very little additional drag as they move through the sawdust. Pulleys 72 and 73 and the connecting pulley belt 75 are preferably enclosed within a safety cover 79**.

Figure 9:
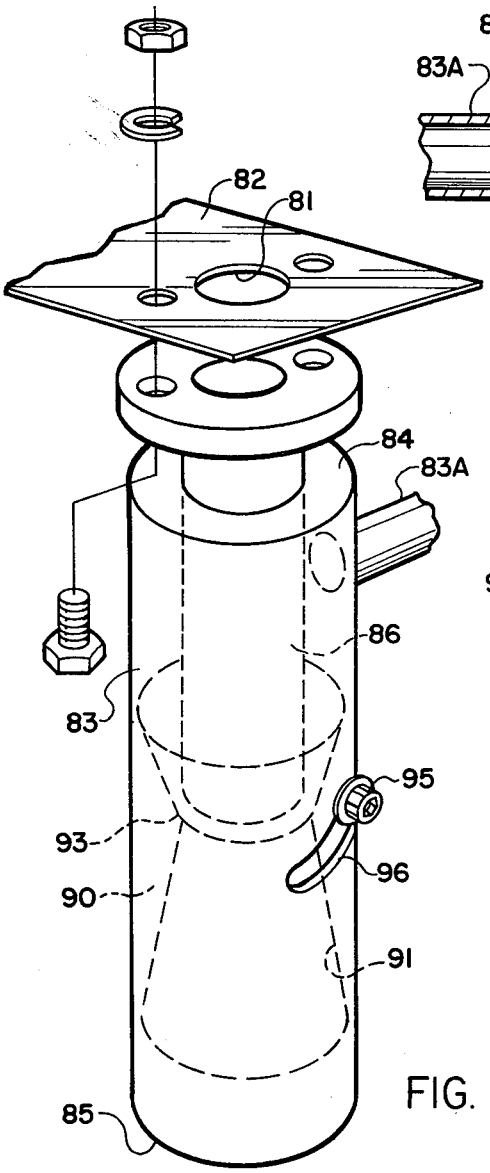
Figure 8:
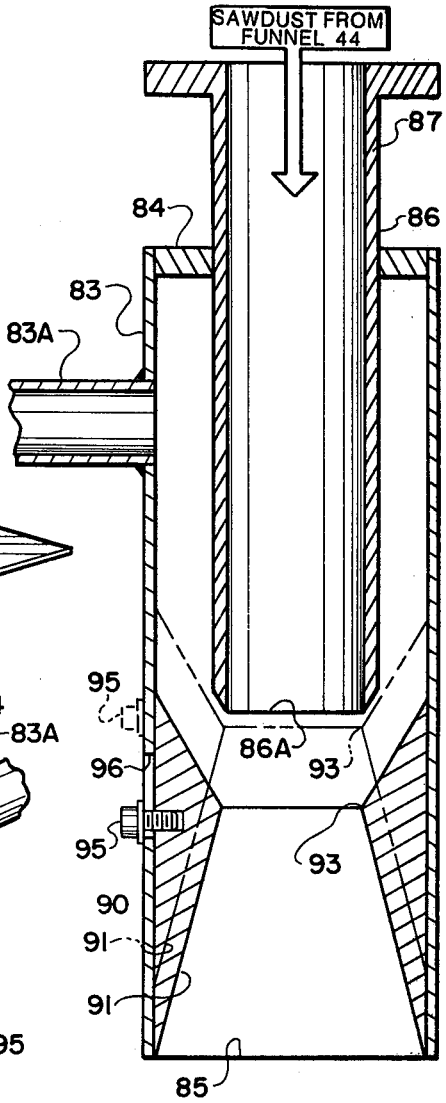
FIG. 8 is a vertical cross sectional view of a venturi which disperses fuel into a stream of air and injects the fuel into the kiln; and, FIG. 9 is a perspective view of the venturi with certain inner components shown in phantom lines.

As sawdust is deposited from pockets 52 into each funnel 44, it passes into a venturi 80, as is shown in FIG. 2. Each venturi 80 communicates with a respective funnel 44 through an aperture 81 in a mounting plate 82, to which venturi 80 is mounted by bolts. Venturi 80, as is shown in FIGS. 8 and 9, is comprised of an air jacket 83 having a pre-determined large size cross sectional diameter. Air jacket 83 has an air supply pipe **83*a*, an enclosed end 84, and defines a discharge opening 85 on the opposite end. A fuel injector 86, having a through bore 87, is positioned in and communicates through the enclosed end 84 of air jacket 83. As is shown in FIG. 8, the outside diameter of fuel injector 86 is less than the inside diameter of air jacket 83 and defines an air space therebetween. Also, a discharge end 86*a* of fuel injector 86 terminates within the space defined by the walls of air jacket 83. Still referring to FIG. 8, an air flow restrictor 90 is positioned within air jacket 83 between the discharge end 86*a* of fuel injector 86 and the discharge opening 85 of air jacket 83. Air flow restrictor 90 has a through bore 91 therethrough. Bore 91 has its largest diameters at its extreme opposing ends. The walls of air flow restrictor 90 converge towards each other to define a relatively smaller diameter annular throat 93. Therefore, bore 91 defined by the walls of the air flow restrictor 90 resembles an hourglass in cross section. Air flow restrictor 90 serves to deflect the air as it enters air jacket 84 through air supply pipe 83*a* and travels toward the discharge opening 85. Air flow restrictor 90 may be moved towards or away from the discharge end 86*a* of fuel injector 86 by means of an adjustable bolt 95 tapped into air flow restrictor 90 and extending through a slot 96 through the walls of air jacket 93**.

As is shown in FIG. 8, the walls on the discharge end **86*a* of the fuel injector 86 are tapered at an angel to correspond with the inwardly projecting angle of the upper, adjacent wall of the air restrictor 90. This permits air escaping between the two surfaces to pass in a smooth, parallel flow and intersect in a vortex directly beneath the discharge end 86*a* of the fuel injector 86. The movement of the high pressure air past the discharge opening of fuel injector 86 creates a low presure zone which accelerates sawdust dropping down the fuel injector 86 into the vortex where it is susended in the moving air. As the column of air expands along the tapered lower walls 91 of air restrictor 90**, the sawdust is evenly dispersed.

Referring again to FIG. 2, compressed air is supplied to each injector by an air supply conduit 100 which branches into individual air supply hoses 101. Air supply hoses 101 are connected to air inlet **83*a* by means of lfexible pneumatic hoses 102. Air pressure is regulated by valves 104**.

Air is preferably maintained at a constant pressure. The velocity of the air at the venturi 80 therefore stays the same. The quantity of air is regulated by adjusting air flow restrictor 90 upwardly or downwardly, into or out or proximity to the discharge end **86*a* of fuel injector 86**. Once the desired fuel-to-air ratio is determined, the quantity of air can thus be increased or decreased to correspond to increases or decreases in the amount of sawdust being fed into the kiln.

The structure described above makes it possible to increase or decrease the feed rate of sawdust in a linear manner over a very wide range. From experimentation it has been shown that if each circular disk 50 feeds 100 grams of sawdust at 10 RPM, it wil deliver 200 grams of sawdust at 20 RPM and 300 grams of sawdust at 30 RPM; any minute variations being the result of varying sawdust density. Direct drive motor 54 permits very precise adjustments in RPM to be made instantaneously. RPM adjustment can be made manually or by means of a motor speed control 56, referred to above. Motor speed control 56 may comprise a servo-mechanism which receives information form one or more thermocouples inside the kiln 10. An above-standard temperature signals a decrease in the RPM of motor 54, which results in a directly proportional decrease in the rate at which sawdust is fed into the kiln. Conversely, a below-standard temperature sensed by the thermocouple will cause motor speed control 56 to increase the speed of motor 54, causing the rate of sawdust being fed into the kiln 10 to increase.

It is also important to note that temperature can vary in a non-standard manner across the width of the kiln. This factor can be compensated for either by increasing or decreasing the number of pockets 51 around the periphery of the circular disk 50 which feeds sawdust to the location in the kiln 10 where temperature correction is desired. Alternatively, the volumetric capacity of pockets 51 can be increased or decreased. This requires no deviation in feed rate of the other circular disks 50. The motor 54 continues to drive all of the circular disks 50 at exactly the same RPM. Motor 54 can be of a relatively small horsepower, since each circular disk 50 is in contact with drag-producing sawdust during only a very small portion of each revolution. The entire system, therefore, permits precise control of temperature within a kiln while comsuming very little energy.

The straight-line feed of the sawdust from the pockets 51 into venturis 80 completely eliminates the problem of chokes or clogs resulting from trying to pass sawdust around sharp angles or past obstacles in the feed systems. The sawdust falls under its own weight into venturi 80 where it is dispersed in the pressurized air stream. Once so dispersed, the air-sawdust mixture can be passed through conduits or pipes having curves or sharp angle bends. For this reason, use of the apparatus 30 according to the present invention on a side-fed kiln would be as shown in FIG. 2, with each apparatus 30 being mounted adjacent the side of the kiln, permitting sawdust to be fed by gravity in a straight-line path to each venturi 80, whereupon a flexible hoze would carry the air-sawdust mixture laterally into the side of the kiln.

An apparatus for dispensing particulate matter is described above. Various details of the invention may changed without departing from its scope. Furthermore, the foregoing description of a preferred embodiment of the apparatus according to the present invention is provided for the purpose of illustration only and not for the purpose of limitation—the invention being defined by the claims.

I claim:

1. An apparatus for dispensing and injecting solid fuel in particulate form into a combustion chamber in measured quantities and at variable rates and intermittencies, and comprising:

(a) a fuel supply source;

(b) at least one circular disk for being mounted for rotation at a uniform and continuous speed and in particulate matter receiving relation to the fuel supply source the circumferential perpiphery of said disk defining first and second arcs; the circumferential periphery of said disk defining said first arc having a plurality of spaced-apart pockets therein for receiving and dispensing particulate matter from the supply source during the interval or rotation of said arc in particulate matter receiving relation to the fuel supply source, and said second arc having a continuous, uninterrupted circumferential periphery greater than any one of the spaces between the spaced-apart pockets of said first arc for passing in particulate matter receiving relation to the fuel supply source without receiving or dispensing particulate matter therefrom, whereby fuel is received and dispensed from said supply source at rates and intermittencies corresponding to the speed of rotation of said circular disk and the volumetric capacity and spacing of the pockets around the circumferential periphery of said first arc in relation to the continuous uninterrupted circumferential periphery defined by said second arc;

(c) each said disk defining at least two mateable disk segments having complementary, non-circumferential sides, at least one of said segments having a plurality of pockets therein at spaced-apart interval around its circumferential periphery;

(d) means for rotating said at least one circular disk; and, (e) means for dispersing said fuel after being dispensed by said at least one circular disk in a stream of air and injecting said fuel into a combustion chamber.

2. An apparatus according to claim 1, and including a plurality of said circular disks being mounted in axially spaced-apart relation on a common, rotatable shaft.

3. An apparatus according to claim 1, wherein each of said disk segments is provided with pockets therein at spaced-apart intervals around their respective circumferential peripheries.

4. An appparatus according to claim 1, wherein said disk segments are each semicircular.

5. An apparatus according to claim 1 and including a flange mounted on said shaft for rotation therewith, and means for permitting the mounting to or removal from said flange of any one of said disk segments without the mounting to or removal from said flange of any other of said disk segments.

6. An apparatus according to claim 1 wherein said means for dispersing said fuel after dispensing by said circular disk in a stream of air and injecting said fuel into a combustion chamber comprises a venturi.

7. An apparatus according to claim 6 wherein said venturi comprises:

(a) an air jacket having a pre-determined large size cross sectional diameter enclosed on one end thereof and defining on the other end thereof a discharge opening;

(b) a fuel injector for conveying fuel from said circular disk to said air jacket, said fuel injector being positioned in and communicating through the closed end of said air jacket and having a pre-determined small size outside diameter thereby defining an air space between the inner walls of said air jacket and the outer walls of said fuel injector;

(c) adjustable air flow restriction means positioned in and cooperating with the inner walls of said air jacket for adjusting the air pressure and air velocity between said fuel injector and the discharge opening of said air jacket; and, (d) means for introducing pressurized air into said air jacket upstream from said air flow restriction means.

8. An apparatus according to claim 1, wherein said pockets each comprise a generally radially extending cut-out in the body of said disk.

* * * * *